US007837057B2

(12) United States Patent
Zeiron

(10) Patent No.: US 7,837,057 B2
(45) Date of Patent: Nov. 23, 2010

(54) DISPENSER FOR INDIVIDUAL FOLDED WEBS

(75) Inventor: Kent Zeiron, Gothenburg (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 11/584,643

(22) Filed: Oct. 23, 2006

(65) Prior Publication Data

US 2007/0034639 A1 Feb. 15, 2007

Related U.S. Application Data

(63) Continuation of application No. PCT/SE2004/000700, filed on May 7, 2004.

(51) Int. Cl.
*A47K 10/24* (2006.01)

(52) U.S. Cl. ..... 221/47; 221/48; 221/52; 221/51; 221/55; 221/41

(58) Field of Classification Search ..... 221/1–312 C, 221/33, 47, 52, 55, 48, 51, 63, 24, 41
See application file for complete search history.

(56) References Cited

U.S. PATENT DOCUMENTS

| | | | | |
|---|---|---|---|---|
| 1,993,885 | A * | 3/1935 | Horwitt | 221/55 |
| 2,080,691 | A * | 5/1937 | Broeren | 221/55 |
| 2,547,856 | A * | 4/1951 | Cofrin et al. | 221/55 |
| 2,852,158 | A * | 9/1958 | Jones et al. | 221/35 |
| 3,203,586 | A * | 8/1965 | Downham | 221/55 |
| 3,425,595 | A | 2/1969 | Shapira | |
| 4,329,001 | A * | 5/1982 | Filipowicz et al. | 312/71 |
| 4,469,243 | A * | 9/1984 | Ito et al. | 221/34 |
| 5,118,554 | A * | 6/1992 | Chan et al. | 428/126 |
| 5,716,691 | A * | 2/1998 | Chan | 428/126 |
| 6,045,002 | A * | 4/2000 | Wierschke | 221/48 |
| 6,286,713 | B1 * | 9/2001 | Chan et al. | 221/49 |
| 6,352,172 | B1 * | 3/2002 | Chan et al. | 221/63 |
| 6,758,369 | B2 * | 7/2004 | Morin et al. | 221/48 |
| 6,988,635 | B2 * | 1/2006 | Hochtritt et al. | 221/44 |
| 7,134,571 | B2 * | 11/2006 | Hochtritt et al. | 221/44 |
| 2002/0040913 | A1 * | 4/2002 | Moody et al. | 221/63 |

FOREIGN PATENT DOCUMENTS

| | | |
|---|---|---|
| EP | 0 506 243 | 9/1992 |
| WO | WO 98/40002 | 9/1998 |

* cited by examiner

*Primary Examiner*—Gene Crawford
*Assistant Examiner*—Michael K Collins
(74) *Attorney, Agent, or Firm*—Young & Thompson

(57) ABSTRACT

A dispenser for individual webs from a stack of such individual webs. The dispenser includes an outer housing defining an interior space; stacking elements mounted within the outer housing for holding a stack of individual folded webs within the interior space; a dispensing face defined in the outer housing proximate to an end of the stacking elements; a stack of individual folded webs, and at least one edge of a dispensing opening which contacts the stack of individual folded webs so that a portion of individually folded webs is exposed by the dispensing opening. In addition, a cross-section through dispensing face has a curved shape with an inflection point.

18 Claims, 10 Drawing Sheets

DISPENSER FOR INDIVIDUAL FOLDED WEBS

FIELD OF THE INVENTION

This invention generally relates the field of dispensing devices and systems. More particularly, this invention relates to the field of devices and systems for dispensing folded sheets of material.

BACKGROUND OF THE INVENTION

Dispensers for individual folded webs such as paper napkins are often provided at quick service food locations and restaurants. One disadvantage of many conventional paper napkin dispensers is that they often provide rather poor single feed dispensing of folded napkins. Such inadequate single feed dispensing can be particularly noticeable if the napkins are individual folded napkins (e.g., conventional overfold napkins) instead of interfolded napkins. Another disadvantage is that both conventional overfold napkin dispensers and interfolded napkin dispensers often permit removal of multiple napkins at one time. As a rule, most paper napkins removed in this manner are wasted unnecessarily. Many end up scattered about an eating area, on tables or are merely discarded as litter. When multiple of napkins are removed in this way dispensers quickly run out and must be refilled, which is an inconvenience for both customers and operators of quick service food locations and restaurants.

Common problems with conventional overfold paper napkins have been described in, for example, WO 98/40002. Conventional overfold paper napkins are designed to be stacked in a napkin dispenser such as, for example, a spring loaded napkin dispenser or a gravity feed dispenser. Such napkin dispensers have an opening revealing an open end of an outermost napkin facing the opening. In this position, a user can grab an exposed section of a napkin to pull the napkin out of the dispenser.

However, when stacked improperly with the wrong end of the napkin facing the opening, dispensing is awkward, and often results in wastage. Not uncommonly, maintenance personnel will stack overfold paper napkins improperly, or stack too many napkins thereby overfilling the dispenser.

The invention is aimed at achieving an improved dispenser avoiding problems relating to the feeding out and presenting of individual folded webs. The invention is further aimed at avoiding problems relating to wasteful dispensing in dispensers for individual folded or interfolded webs.

SUMMARY OF THE INVENTION

It is therefore an object of the present invention to provide dispenser for individual webs from a stack of such individual webs that solves the above problems.

According to the invention, the dispensing face has a front portion projecting out from the dispenser, wherein a cross-section through the face has a general S-shape with an inflection point that will be described in more detail below. Preferably, the dispensing opening is located about an inflection point on or an inflection line across the front surface in an area, preferably but not necessarily, adjacent a central portion of the face.

The definition of an inflection point is a point on a curve at which the sign of the curvature (i.e., the concavity) changes. Inflection points may be stationary points, but are not relative maxima or relative minima. For example, for the curve $y=x^3$ plotted in FIG. 1, for one embodiment of a dispenser, the point $x=0$ is an inflection point. Usually, a so called first derivative test may distinguish inflection points from extrema for differentiable functions $f(x)$. However, the shape of the dispensing face is neither limited to follow any particular mathematical function, nor to symmetrical on either side of the inflection point. A number of examples will be described in detail below.

According to a preferred embodiment, the invention relates to a dispenser for individual webs from a stack of such individual webs, the dispenser comprising: an outer housing defining an interior space; stacking means mounted within the outer housing for holding a stack of individual folded webs within the interior space; a dispensing face defined in the outer housing proximate to an end of the stacking means; a stack of individual folded webs having an area of non-uniform thickness across the length of the web aligned so that an area of greatest thickness extends across the width of a dispensing opening; and at least one edge of the dispensing opening which contacts the stack of individual folded webs so that a portion of the stack of individual folded webs is exposed by the dispensing opening. A cross-section through the dispensing face, in a plane parallel to the direction of feed of the webs and at substantially right angles to an exposed edge or fold across the web, has a curved shape with at least one inflection point. An individual web to be dispensed through the opening will be pushed forwards to conform to the rear surface of the dispensing face.

The shaped dispensing face causes the main part of the web to assume the same shape, at least in the areas surrounding the dispensing opening. By indexing the dispensing opening with an exposed edge or fold across the web, a user may remove the outermost web by gripping the edge or fold. By positioning the edge or fold over an outwardly convex section of the dispensing face, this part of the web will assume a presentation position away from the plane of the main body of the web to facilitate removal of single webs in succession. The convex section of the dispensing face facing the user forms part of the outermost end section of the dispenser.

According to one example, the cross-section through the dispensing face may be given a general, or approximate S-shape.

In a further embodiment, inflection points are provided in successive cross-sections through the dispensing face across at least a part of the entire width of the face. By joining the successive inflection points the point would appear to be located in a line across or adjacent the dispensing opening.

According to an alternative embodiment, a line of inflection points are provided in successive cross-sections through the dispensing face on either side of the dispensing opening. In this case the inflection points would appear to be located in an imaginary line across the dispensing opening.

In both the above embodiments the inflection points may be located in a line positioned in a plane substantially parallel to an outer wall of the housing. Such an outer wall would normally be one of the side walls to which the dispensing face or its stacking means is secured. This wall is as a rule located in a substantially horizontal plane, although a vertically arranged wall is possible. The stacking means may comprise a drawer section to which the dispensing face is attached, wherein the folded webs are stacked in the drawer section.

In an alternative embodiment, the inflection points may be located in a line positioned at an angle to a plane parallel to an outer wall of the housing.

In a further alternative embodiment, the inflection points may be located on a curved, convex line across the entire width of the dispensing face. This curved line may follow a radius, to give a constant curvature across the entire width of the dispensing face. Alternatively it may follow a part of an elliptic curve, to give variable curvature across the face.

According to a further alternative, the curved line may also have a constant or variable curvature across at least a part of the dispensing face, preferably coinciding with at least a part of the dispensing opening. Such a curved line may be located either symmetrically or offset relative to a centreline through the dispenser housing in a horizontal plane.

For the above embodiments describing inflection points located on a curved, convex line, the dispenser face is assumed to have a generally S-shaped cross section in a vertical plane. According to one embodiment, the curvature curved, convex line may be constant for substantially all cross-sections in a horizontal plane.

Alternatively, the curvature of the curved line may vary in the horizontal direction, whereby a maximum value for the curvature of the line coincides with the line of inflection points and/or the general area of the exposed edge of the folded web. Consequently, the respective upper and lower edges of the dispensing face may have a maximum value for the curvature and/or be in the shape of a straight line.

The stack of individual folded webs to be dispensed by the system according to the invention is preferably, but not necessarily, a stack of fibrous webs. Preferably, the stack of folded webs is a stack of absorbent paper webs such as, for example, absorbent paper napkins.

According to a further preferred embodiment, an edge or fold of an outermost web exposed by the dispenser opening may be located substantially parallel with or at least in the general direction of a line of inflection points. However, the line of inflection points located at an angle relative to the edge or fold. The line may also have the shape of a curve relative to the edge or fold.

Similarly, a stack of individual folded webs having an area of non-uniform thickness across the length of the web may be aligned so that an area of greatest thickness of an outermost napkin extends across the width of the dispensing opening substantially parallel with or at least in the general direction of a line of inflection points.

For all the above embodiments, the edge or fold should be located across the convex section of the dispensing face, in a position between the line of inflection points and an edge of the dispensing opening. The latter edge is preferably substantially parallel to the edge or fold of the web, but may also be substantially parallel to the line of inflection points. As stated above, a sufficient portion of the web must be exposed by the dispensing opening to ensure that the web will assume a presentation position away from the general plane of the main body of the web to facilitate removal of single webs in succession.

According to the invention as described in the above embodiments and the following examples, the dispenser is preferably, but not necessarily, designed for dispensing folded sheet products from a stack of individual folded webs. The term "individual webs" is defined as including either of individually stacked webs, overfolded webs or interfolded webs, or similarly arranged sheet products. The webs may or may not be joined by manually separable perforations or by a number of local attachment zones or connecting points. The stack of individual folded webs may be a stack of fibrous webs. Desirably, the stack of folded webs is a stack of absorbent sheets or webs such as, for example, absorbent non-woven products. More desirably, the stack of folded webs is a stack of absorbent fibrous or paper sheets or webs such as, for example, napkins, towels, tissues or the like.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying description of the invention.

BRIEF DESCRIPTION OF DRAWINGS

In the following text, the invention will be described in detail with reference to the attached drawings. These drawings are used for illustration only and do not in any way limit the scope of the invention. In the drawings.

DETAILED DESCRIPTION OF THE INVENTION

Figure 1A:
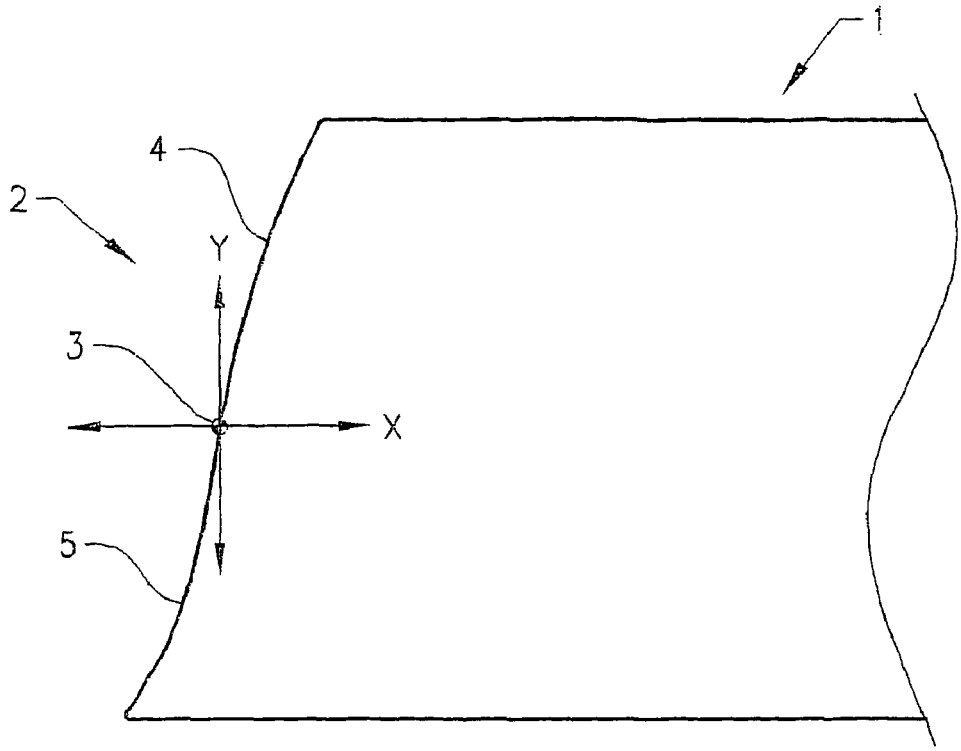
FIG. 1A shows a side view of a dispensing face for a dispenser according to the invention.
Figure 1B:
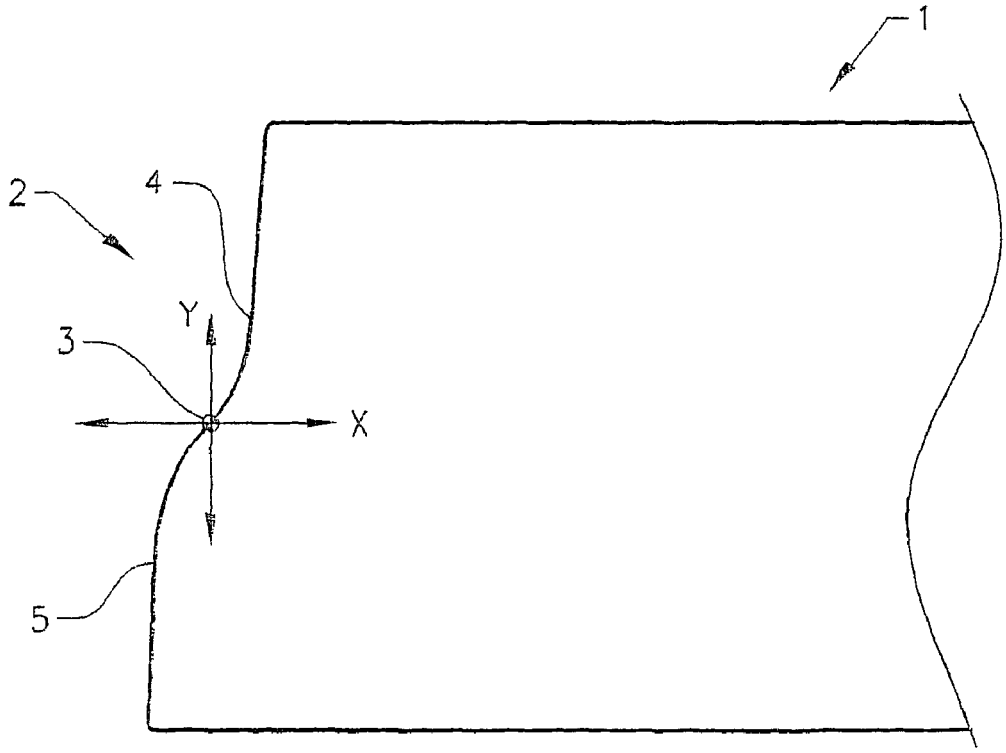
FIG. 1B shows an alternative side view of a dispensing face for a dispenser according to the invention.

FIGS. 1 and 1B show alternate side views of a dispensing face for a dispenser according to the invention. By way of example only, the dispenser 1 has been provided with a dispensing face 2 that in a side view, or in cross-section, has the approximate shape of a curve defined by the equation $y=x^3$ with an inflection point 3 in the middle section of the dispensing face 2. The axes x and y defining the position of the curve, in relation to the front face of the dispenser, are located in a horizontal and a vertical plane respectively. This positioning of the inflection point 3 gives the dispensing face a concave shape 4 across the width of the upper part of the face, and a convex shape 5 across the width of the lower part of the face.

Figure 2:
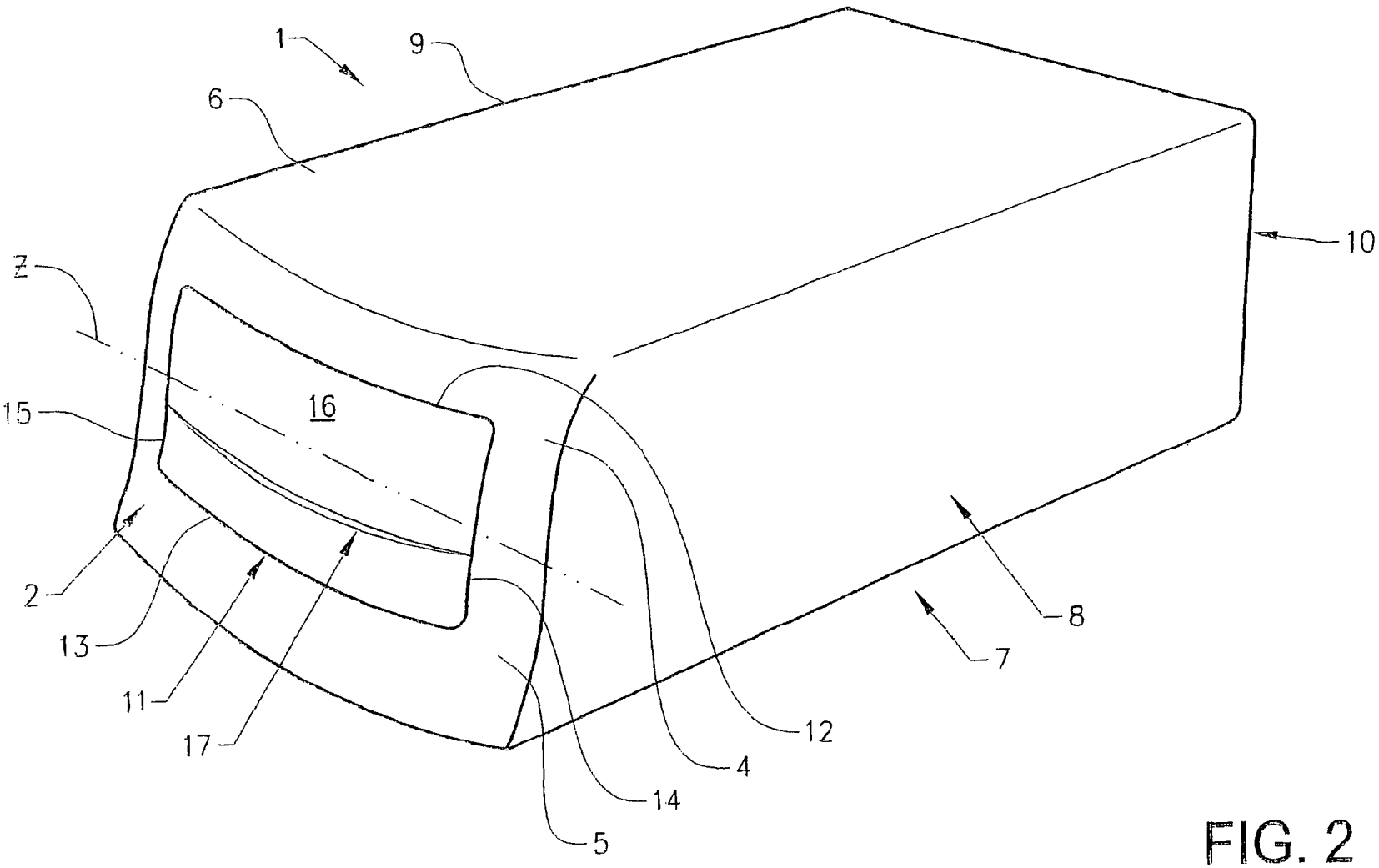
FIG. 2 shows a perspective view of a dispenser according to the invention.

FIG. 2 shows a perspective view of a dispenser according to the invention. The dispenser 1 comprises the dispensing face 2, with its respective upper and lower sections 4, 5, and a housing made up of an upper wall 6, a bottom wall 7, a pair of side walls 8, 9, connecting the upper and lower walls, and a rear wall 10 opposite the dispensing face 5.

Figure 3A:
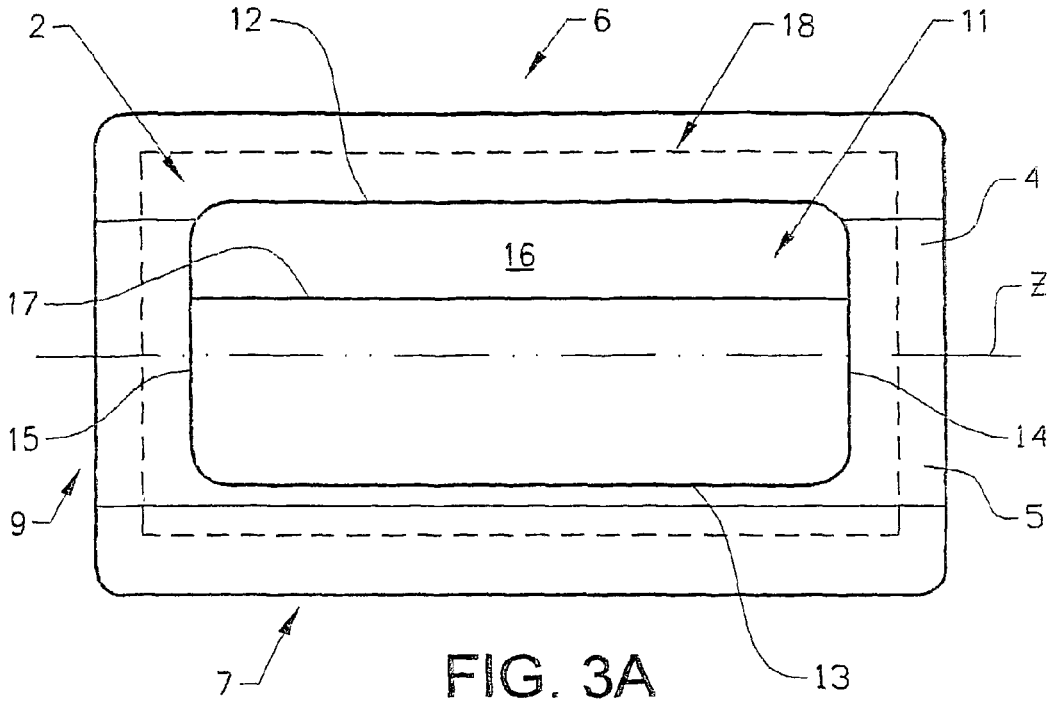
FIG. 3A shows a front view of a dispenser according to FIG. 2.
Figure 3B:
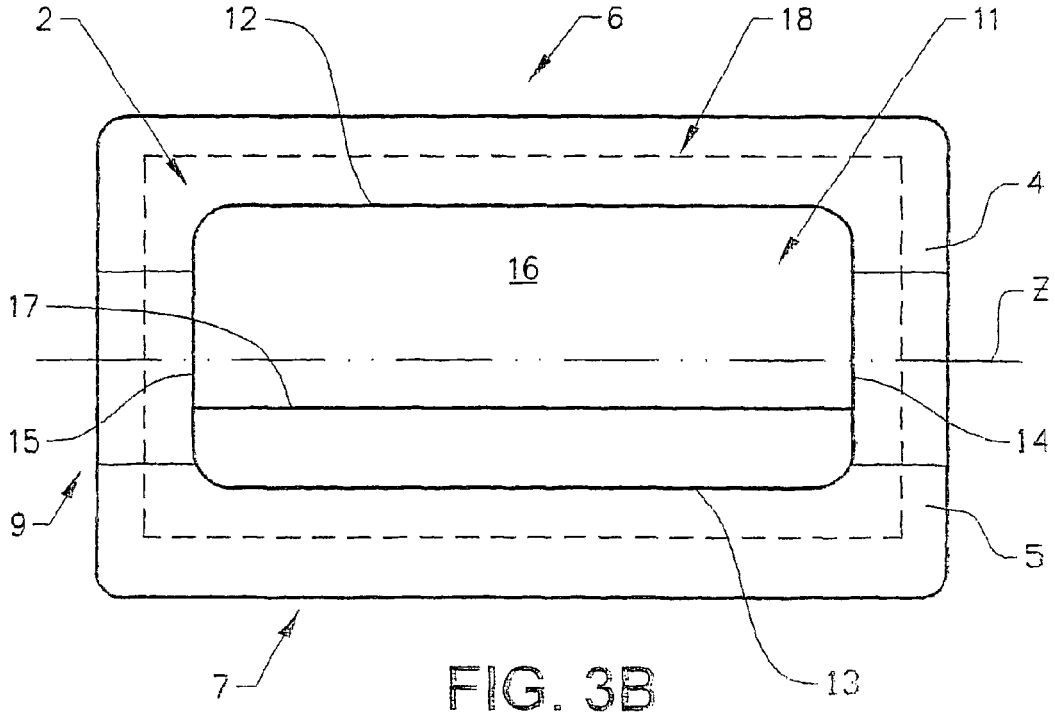
FIG. 3B shows an alternative front view of a dispenser according to FIG. 2.
Figure 5A:
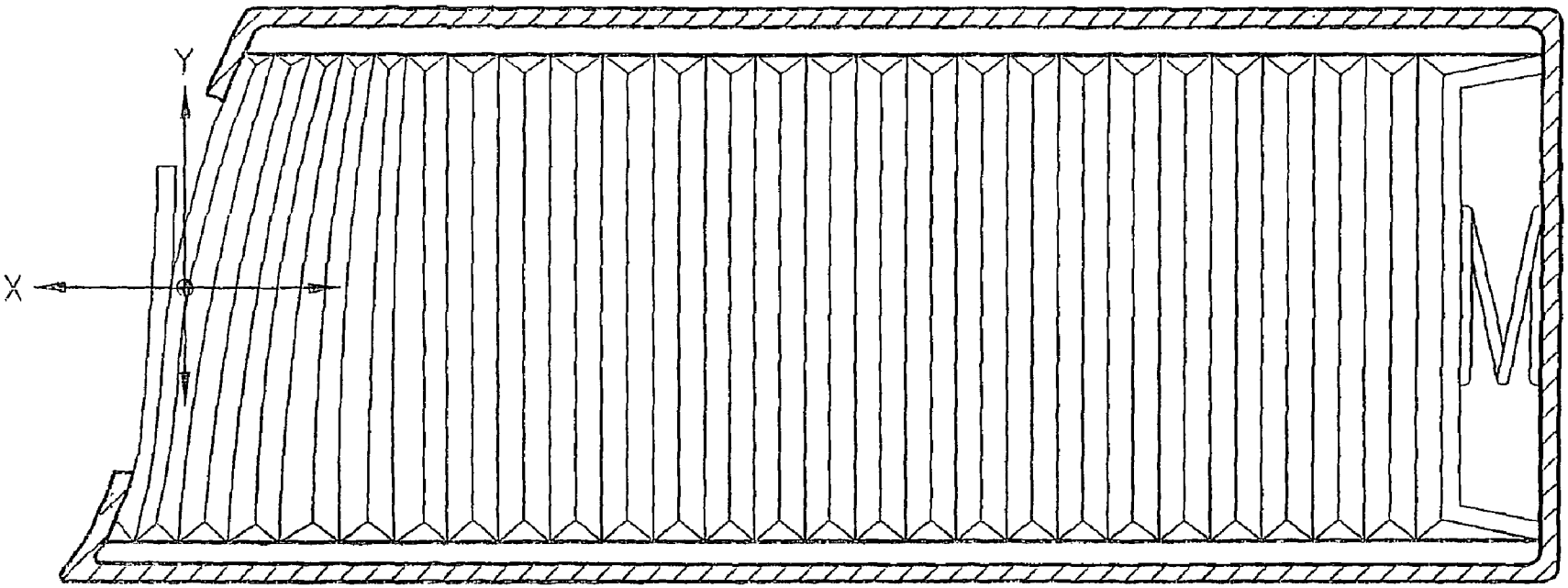
FIG. 5A shows a cross-section in a vertical plane of one alternative embodiment of the dispenser.

The dispensing face 5 is provided with a dispensing opening 11 having an upper and a lower edge 12, 13 and a pair of opposing side edges 14, 15. The size of the dispensing opening limited by the edges is smaller than the size of the web 16 to be dispensed (as indicated in FIGS. 3A and 3B). A web pushed forward by a feeding means, such as a spring (see FIGS. 5A and 5B), will contact the rear side of the curved dispensing face 5 causing the main part of the web to assume the same shape, at least in the area of the edges surrounding the dispensing opening. The outermost, exposed web 16 has a fold or edge 17 extending across its entire width, which fold or edge is gripped by a user wishing to extract a web. The inflection point illustrated in FIGS. 1A and 1B is indicated as a line z formed by successive cross-sections through the dispensing face 3 across the entire width of the face. By joining the successive inflection points the point would appear to be located in a line z, indicated by a dash-dotted line, across the dispensing opening and the adjacent sides of the dispensing face 3. The dispensing opening 11, the fold or edge 17 of the web 16 and the line are arranged so that the fold or edge 17 is located between the line z and the lower edge 13 of the dispensing opening 11. This places the fold or edge 17 in the convex section 5 of the dispensing face 3, causing the fold or edge to assume a presentation position away from the plane of the main body of the web.

Figure 4A:
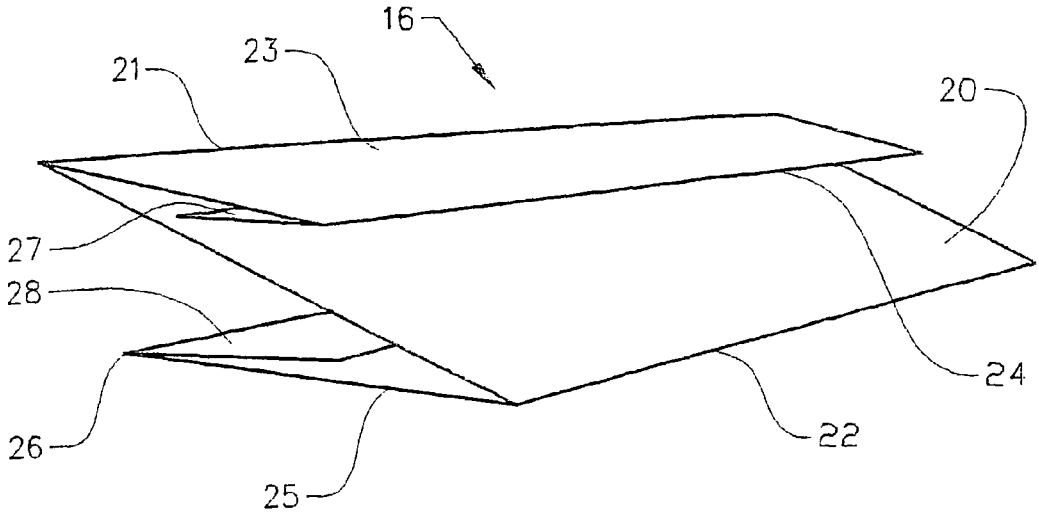
FIG. 4A shows an example of a folded web for use in the dispenser according to the invention.

FIGS. 3A and 3B show alternate front views of a dispenser according to the invention, using the reference numerals of FIG. 2. Theses figures indicate more clearly how fold or edge 17 is located between the line z and the lower edge 13 of the dispensing opening 11. In addition, the approximate location of the outer edges 18 of the web 16 in relation to the edges 12, 13, 14, 15 of the dispensing opening 11 are indicated by a dashed line FIG. 4A shows an example of a folded web for use in the dispenser according to the invention. The individual folded webs are composed of: (a) a first, central panel; (b) a second panel, unitary with the first panel and folded over a first side of the first panel; (c) a third panel, unitary with the first panel, and folded over a second side of the first panel; (d) a fourth panel, unitary with the second panel, and folded so as to be positioned between the first and second panels; and (e) a fifth panel, unitary with the third panel, and folded so as to be positioned between the first and third panels, such that a portion of the third panel and fifth panel overlap a portion of the second panel and fourth panel generating an area of non-uniform thickness across the length of the web.

With reference to FIG. 4A, the folded web 16 includes a first, central panel 20 that has a first fold line 21 at a first end and a second fold line 22 at a second end that is opposite from the first end. The folded web 16, further includes a second panel 23 having a first end that is joined with the first panel 20 at the first fold line 21 and a second end having a third fold line 24 defined thereat. A third panel 25 having a first end that is joined with the first panel 20 at the second fold line 22 further includes a second end having a fourth fold line 26 defined thereat. The folded web 16 also includes a fourth panel 27 that is joined to the second panel 23 at the third fold line 24. The fourth panel 27 is folded with respect to the second panel 23 at the third fold line 24 so that fourth panel 27 is positioned substantially between the first panel 20 and the second panel 23. Similarly, the folded web 16 includes a fifth panel 28 that is joined to the third panel 25 at the fourth fold line 26. The fifth panel 28 is folded with respect to the third panel 25 at the fourth fold line 26 so that the fifth panel 28 will be positioned substantially between the third panel 25 and the first panel 20 when folded as described above.

The combined width of the'second and third panels 23, 25 are greater than the width of the first panel 20, which will result in a web product 16 has a zone or region of non-uniform thickness extending across the length of the folded web product in a central region when the product is folded flat. The width of the first panel 20 is defined as being the distance from the first fold line 21 to the second fold line 22. The width of the second panel 23 is defined as being the distance from the first fold line 21 to the third fold line 24, and the width of third panel 25 is defined as being the distance from the second fold line 22 to the fourth fold line 26.

When loaded into a dispenser 1 according to the invention, a web 16 as described above will have the folded edge 24 (see edge 17 in FIGS. 2, 3A and 3B) exposed for a user to grip. In the case of the example of FIGS. 2, 3A and 3B, the second panel 23 will be in contact with the lower and side edges 13, 14, 15 of the dispenser opening 11. Due to the shape of the side edges 14, 15 of the opening 11, the first panel 20 will conform to the general shape of the dispensing face 2. However, the second panel 23 will only contact the convex section 5 of the dispensing face 2, allowing the second panel 23 and its folded edge 17, 24 to angle away from the first panel 20 in the region between the lower edge 13 of the dispensing opening and the line z (shown in FIGS. 2, 3A and 3B).

Figure 4B:
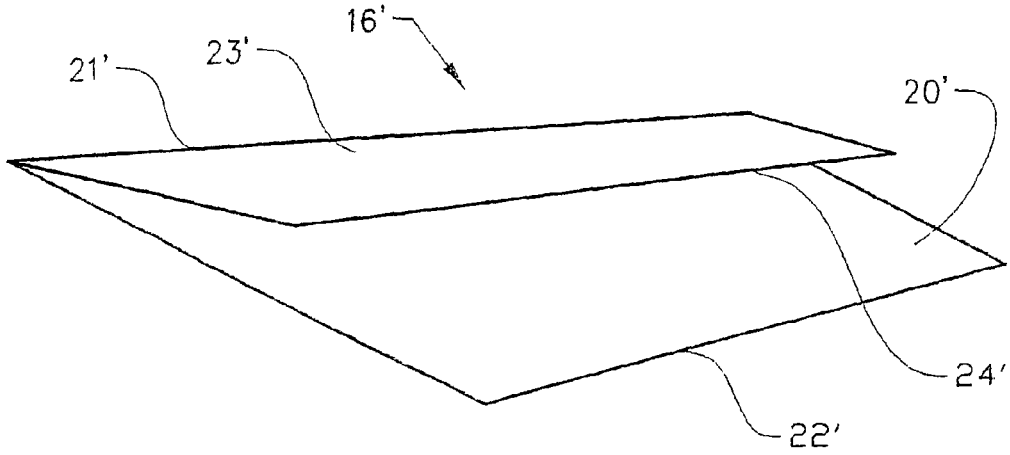
FIG. 4B shows an alternative example of a folded web for use in the dispenser according to the invention.

FIG. 4B shows an alternative example of a folded web for use in the dispenser according to the invention. The individual folded webs are composed of: (a) a first, central panel; (b) a second panel, unitary with the first panel and folded over a first side of the first panel. With reference to FIG. 4B, the folded web 16' includes a first, central panel 20' that has a first fold line 21' at a first end and a first edge 22' at a second end that is opposite from the first end. The folded web 16', further includes a second panel 23' having a first end that is joined with the first panel 20 at the first fold line 21' and a second end having a second edge 24' defined thereat. The folded web may comprise a single, two or four layers, depending on how it is folded. Should it comprise two or more layers, then the second edge 24' will instead be a folded edge. If the web 16' comprises four layers, then the entire length of one of the side edges, at right angles to the first and second edges 21' and 24', will also be a folded edge.

FIGS. 5A, 5B and 6 to 8 show a number of examples of a dispenser according to the invention. With the exception of FIG. 8, all these figures are shown in cross-section in a central vertical plane through a dispenser of the type shown in FIG. 2. The dispensers in the figures include an outer housing 30 defining an interior space 31 that contains a stacking means 32 which is mounted within the outer housing 30 for holding a stack of individual folded webs (e.g., paper napkins) 16 of the type described above within the interior space 31.

The dispenser 1 also includes a dispensing face 2 defined in the outer housing 30 proximate to an end of the stacking means 32. The stacking means 32 is further provided with a pusher plate 33 acted on by a spring means 34, for feeding the stack of webs towards the dispensing opening 11.

Figure 5B:
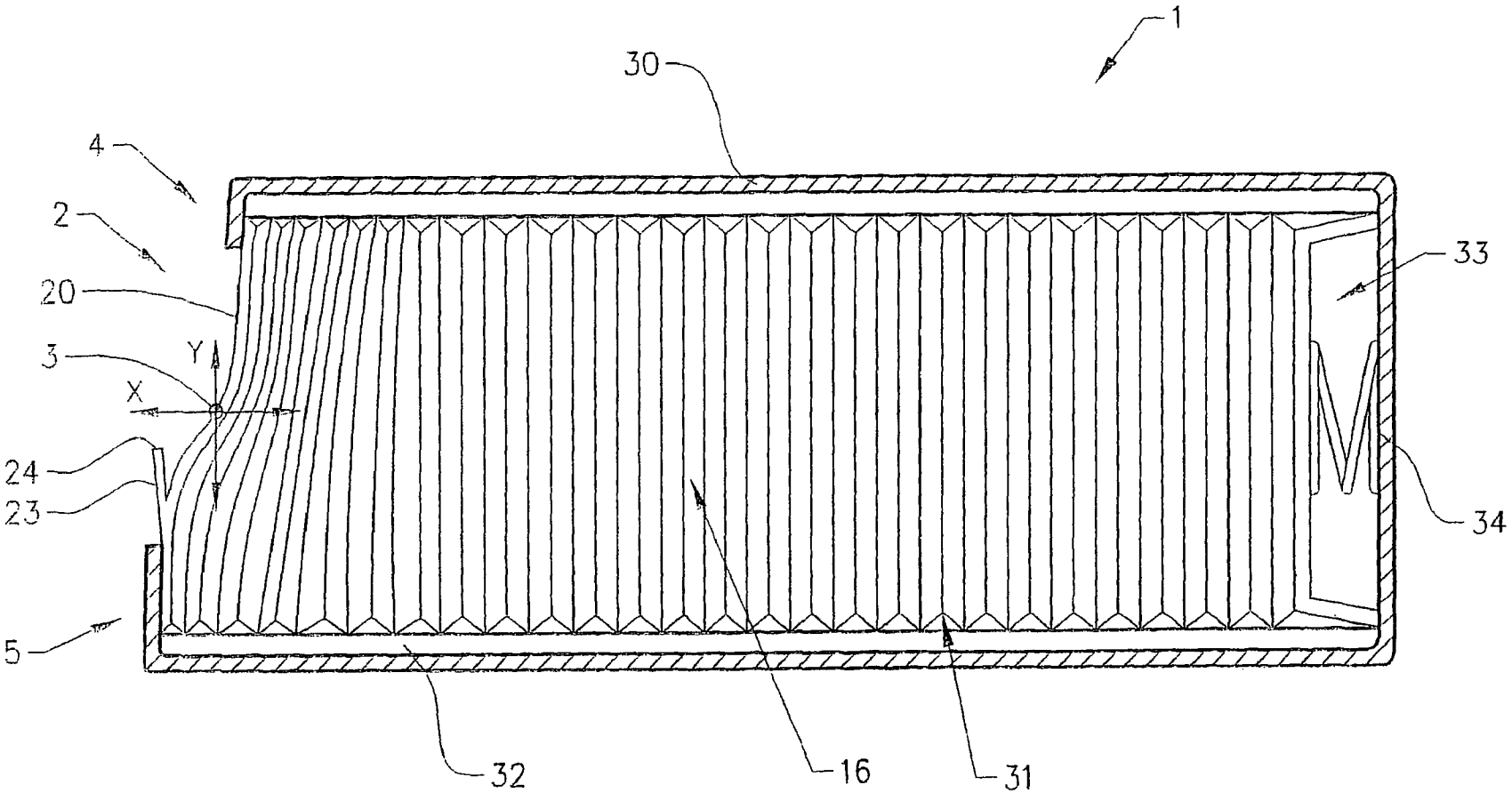
FIG. 5B shows an alternative cross section in a vertical plane of one alternative embodiment of the dispenser.

In FIG. 5B the dispensing face 2 has an inflection point 3 located at approximately half the vertical height of the dispenser 1. The axes x and y defining the position of the curve the front face of the dispenser are located in a horizontal and a vertical plane respectively. This positioning of the inflection point 3 gives the dispensing face a concave shape 4 across the width of the upper part of the face, and a convex shape 5 across the width of the lower part of the face 2. As can be seen in the figure, the first panel 20 conforms to the shape of the dispensing face 2, while the third panel 23 with its folded edge 24 has separated from the first panel 20. In this example the curve the front face of the dispenser is substantially symmetrical with respect to the inflection point.

Figure 6:
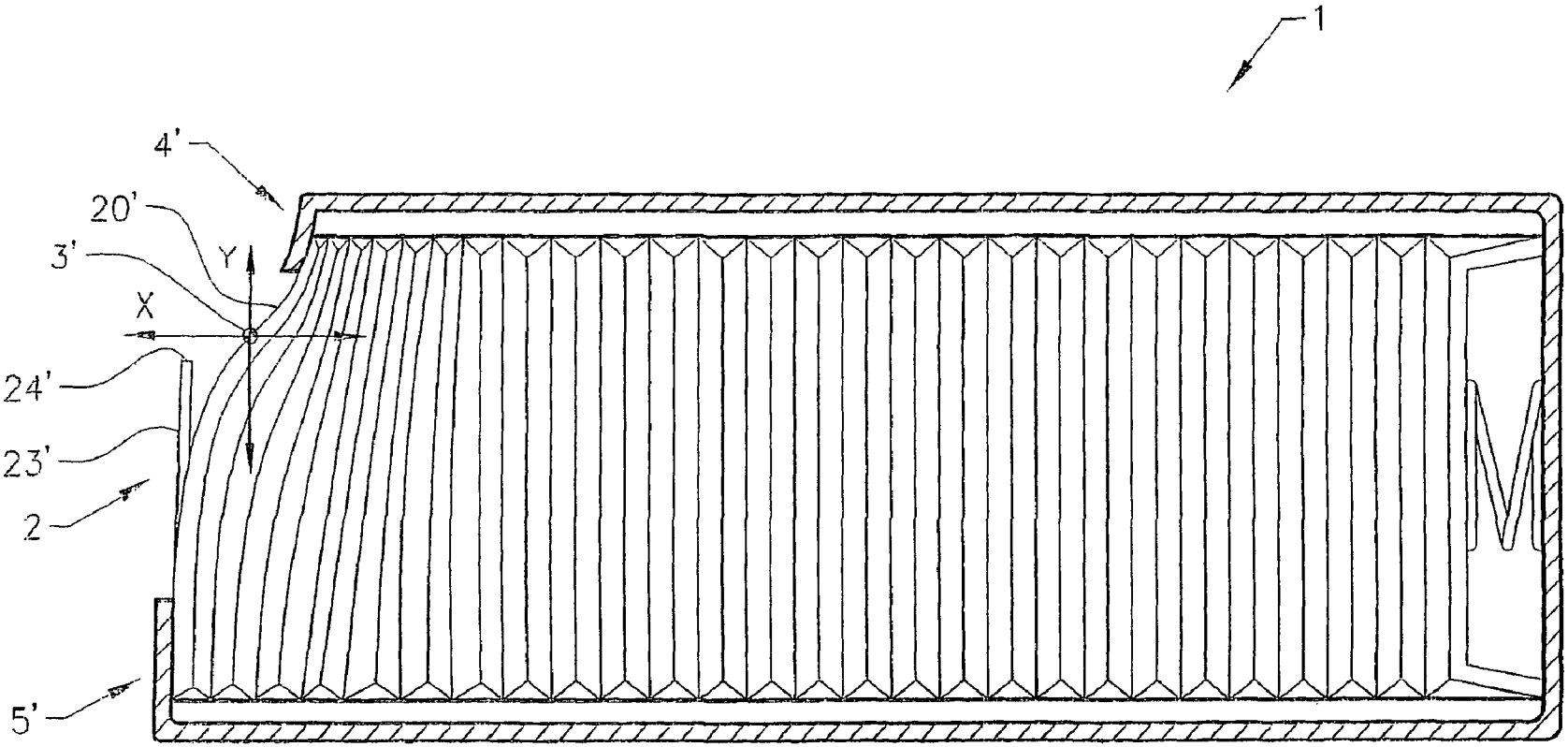
FIG. 6 shows a cross-section of a further alternative embodiment of the dispenser.

In FIG. 6 the dispensing face 2 has an inflection point 3 located at approximately two thirds of the vertical height of the dispenser 1. The axes x and y defining the position of the curve the front face of the dispenser are located in a horizontal and a vertical plane respectively. As in FIG. 5B, this positioning of the inflection point 3' gives the dispensing face a concave shape 4' across the width of the upper part of the face, and a convex shape 5' across the width of the lower part of the face 2. Similarly, the first panel 20' conforms to the shape of the dispensing face 2, while the third panel 23' with its folded edge 24' has separated from the first panel 20'. In this example the curve the upper and lower sections 4', 5' of the dispensing face 2 are asymmetric with respect to the inflection point.

In an alternative embodiment of the example shown in FIG. 6, it is possible to invert the stack of webs. In this case, the second panel would extend from the upper part of the dispensing opening, past the inflection point, into the convex part of the lower section of the dispensing face.

Figure 7:
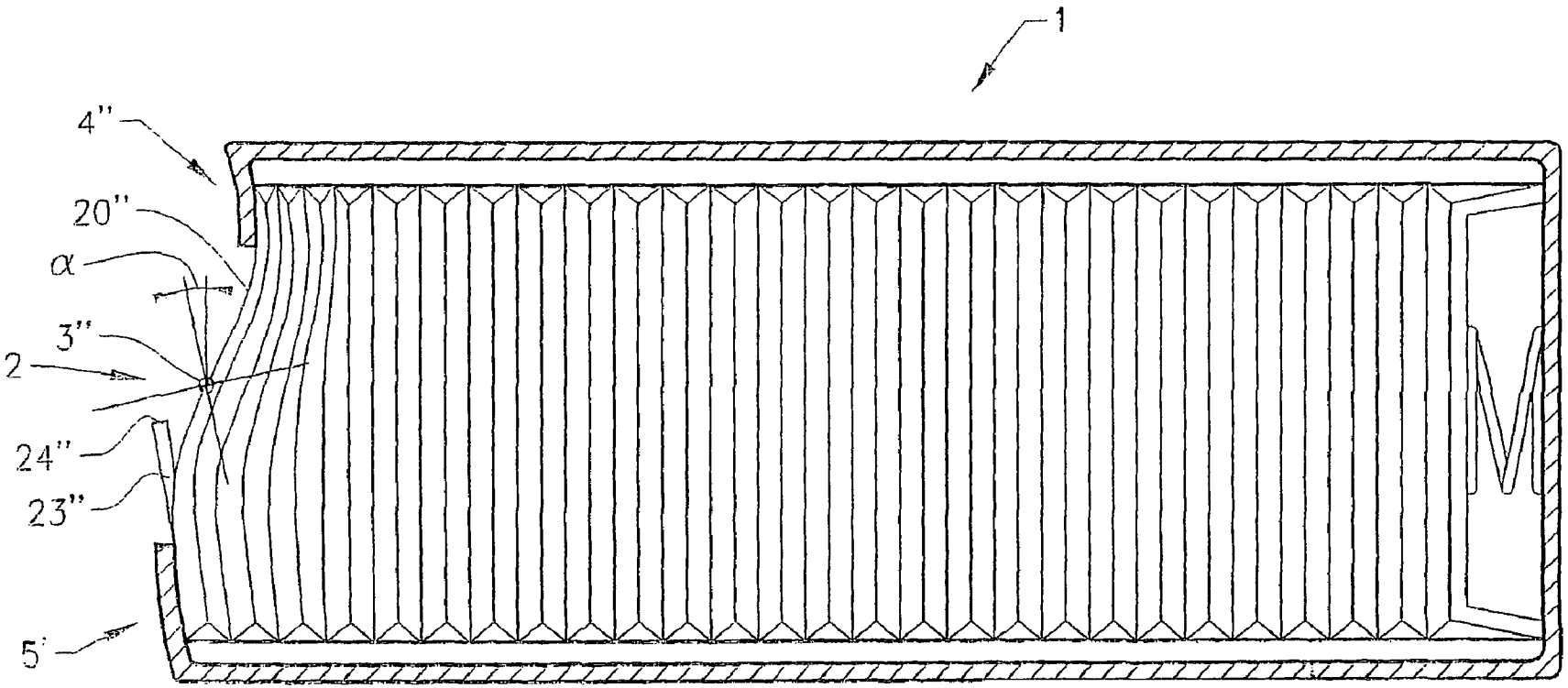
FIG. 7 shows a cross-section of a further alternative embodiment of the dispenser.

In FIG. 7 the dispensing face 2 has an inflection point 3" located at approximately half the vertical height of the dispenser 1. The axes x and y defining the position of the curve the front face of the dispenser are located at an angle $\alpha$ relative to the horizontal and vertical planes respectively. As in FIG. 5B, this positioning of the inflection point 3" gives the dispensing face a concave shape 4" across the width of the upper part of the face, and a convex shape 5" across the width of the lower part of the face 2. Similarly, the first panel 20" conforms to the shape of the dispensing face 2, while the third panel 23" with its folded edge 24" has separated from the first panel 20". In this example the curve the upper and lower sections 4", 5" of the dispensing face 2 are symmetrical with respect to the inflection point.

Figure 8:
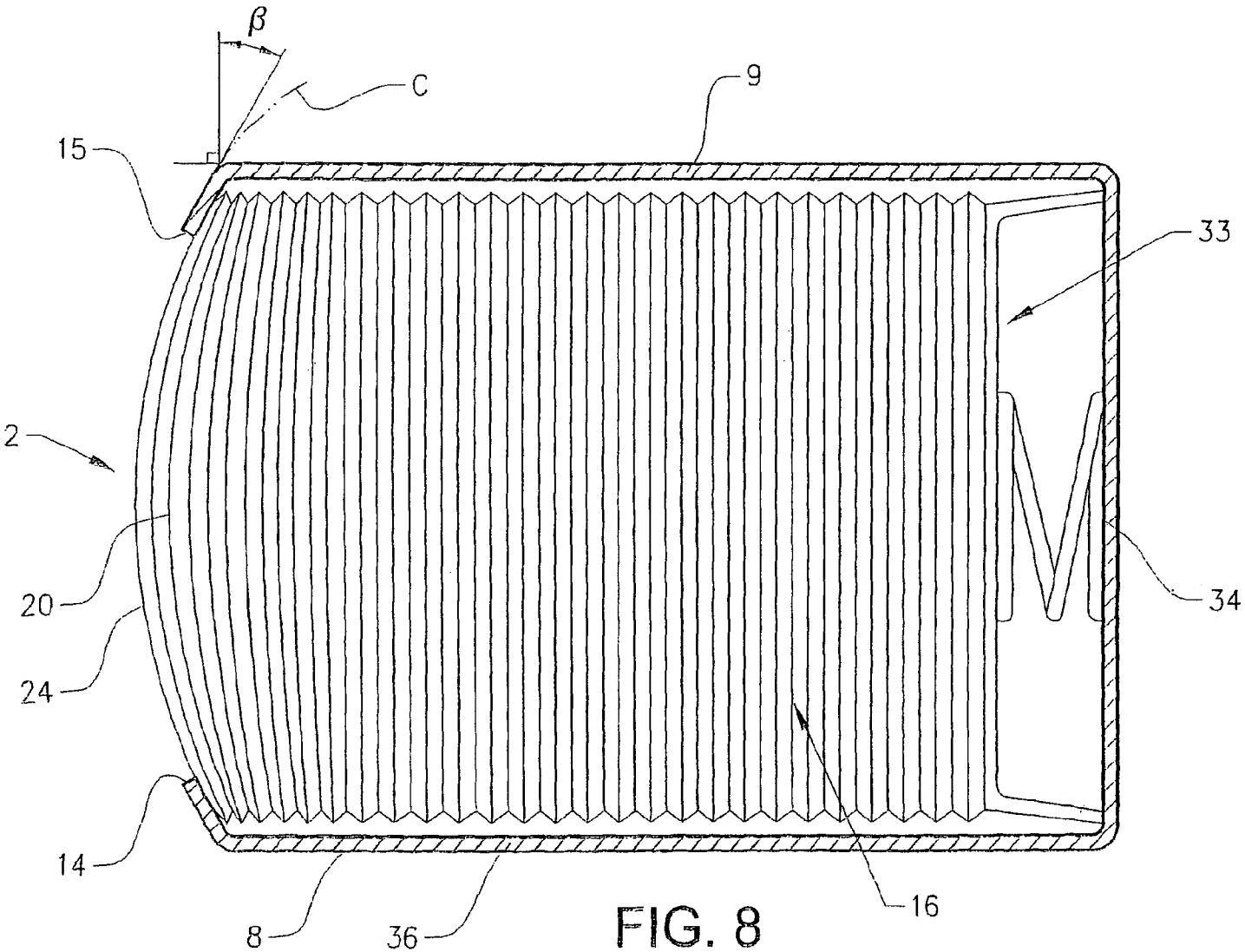
FIG. 8 shows a schematic cross-section in a horizontal plane of one alternative embodiment of the dispenser.

FIG. 8 shows a schematic cross-section in or near a central horizontal plane through the line of inflection points of a dispenser similar to that shown in FIG. 2. Using the reference numerals of FIG. 2, the dispenser is provided with a pair of side walls 8, 9 enclosing a stack of webs 16. The dispensing face 2 has a dispensing opening where the side edges 14, 15 have basically the same cross-section in a vertical plane as indicated in FIGS. 2 and 5. However, instead of forming a straight line (see "z", FIG. 2) the line of inflection points forms a curve C, which curve is convex in the direction of the user. In the horizontal plane shown in FIG. 8, a suitable angle $\beta$ between a tangent to the curve C and a vertical, transverse plane through the dispenser at the point of intersection between the dispensing face 2 and the side walls 8, 9 is in the range 1-20°, preferably 10-20°.

Figure 9:
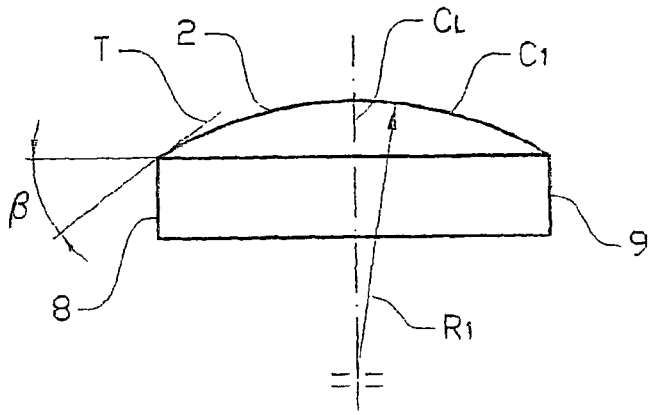
FIG. 9 shows a schematic cross-section in a horizontal plane of a further alternative embodiment of the dispenser.

FIG. 9 shows a cross-section in a central horizontal plane through the line of inflection points of a further embodiment of the dispenser. In this embodiment, the curvature of the curved line is a constant radius $R_1$ having its centre located on the centreline CL through the dispenser housing. As in FIG. 8, the angle $\beta$ is measured between a tangent T to the curve $C_1$ and a vertical, transverse plane through the dispenser at the point of intersection between the dispensing face 2 and the side walls 8, 9. According to one example, the radius $R_1$ of a relatively large dispenser may be selected in the interval 320-335 mm and the angle $\beta$ in the interval 15-18°. According to a further example, the radius $R_1$ of a relatively small dispenser may be selected in the interval 80-130 mm and the angle $\beta$ in the interval 23-26°. These radii and angles are given by way of example only and do not limit the scope of the invention as claimed.

In a modification of FIG. 9, the radius $R_1$ may comprise the major axis of an ellipse, resulting in a curvature that increases with the distance from the centreline CL through the dispenser housing.

Figure 10:
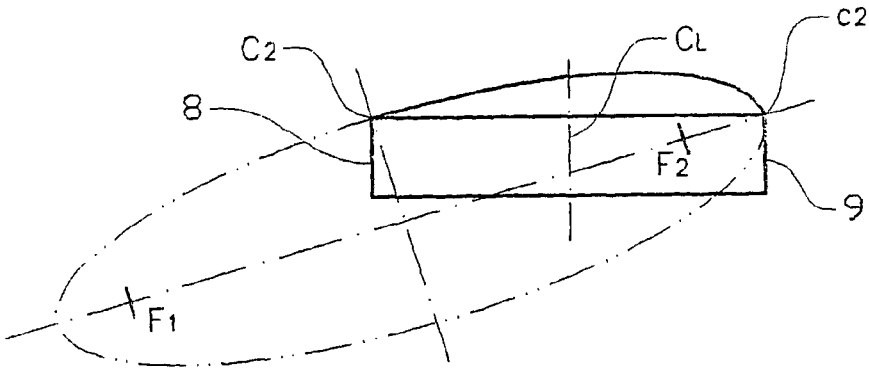
FIG. 10 shows a schematic cross-section in a horizontal plane of a further alternative embodiment of the dispenser.

FIG. 10 shows a cross-section in a central horizontal plane through the line of inflection points of a further embodiment of the dispenser. In this embodiment, the curvature of the curved line has the shape of a partial ellipse, where the foci $F_1$, $F_2$ of the ellipse are located so that a tangent to the largest curvature $C_2$ of the ellipse intersects a vertical plane through one side wall 8 and a tangent to the smallest curvature $c_2$ of the ellipse intersects a vertical plane through the opposite side wall 9.

Figure 11:
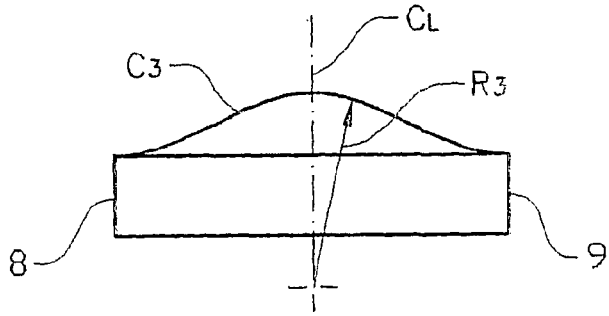
FIG. 11 shows a schematic cross-section in a horizontal plane of a further alternative embodiment of the dispenser.

FIG. 11 shows a cross-section in a central horizontal plane through the line of inflection points of a further embodiment of the dispenser. In this embodiment, the curvature $C_3$ of the curved line follows an approximate sine function, varying from a maximum at the centreline CL of the dispenser housing, where the curve has a radius $R_3$, to a minimum coinciding with the respective intersection points with vertical planes through the side walls 8, 9.

Figure 12:
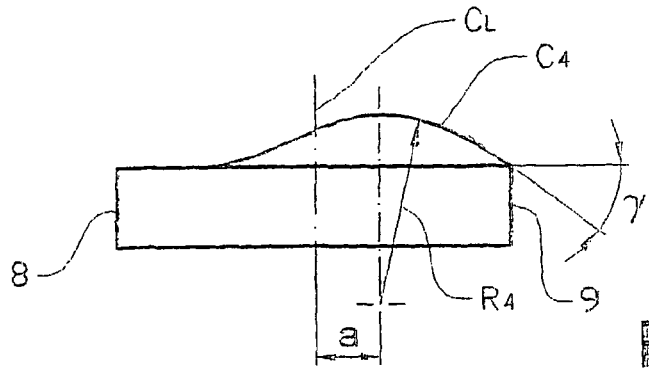
FIG. 12 shows a schematic cross-section in a horizontal plane of a further alternative embodiment of the dispenser.

FIG. 12 shows a cross-section in a central horizontal plane through the line of inflection points of a further embodiment of the dispenser. In this embodiment, the curvature $C_4$ of the curved line is asymmetric with respect to the centreline CL. The curvature has a maximum value with a radius R4 at a location offset a distance a from the centreline. From this point of the curve, the part of the curved line intersecting the centreline follows an approximate sine function, varying from the maximum to a minimum coinciding with the intersection point with a vertical plane through the side wall 8. The remaining part of the curved line maintains a constant radius R4 to the point of intersection with a vertical plane through the opposite side wall 9.

The invention is not limited to the examples given above, as the curvature of the front face in the horizontal plane may be varied freely within the scope of the invention.

By providing such a double curvature in the dispensing face 2, it is possible to facilitate the separation of the folded edge 24 form the first panel 20 (see FIG. 5) even further. For this purpose it is desirable that at least a part of the convex section in the vertical plane is intersected by at least part of the convex curvature in the horizontal plane near the general area of the line of inflection points and/or the exposed edge of the folded web.

The present invention preferably, but not necessarily, intended for use with horizontally placed individual folded paper napkin dispensers, providing reliable and less wasteful dispensing of individual folded paper napkins. Depending on the positioning of the stacking arrangement, the dispenser may also be arranged on its side, that is with the dispensing face and the stacked webs rotated 90° relative to the stacking means. Of course, the dispenser of the present invention may be used with vertically mounted dispensers such as, for example, vertically mounted napkin, tissue or towel dispensers with a lower dispensing opening.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

I claim:

1. A dispenser for individual webs from a stack of such individual webs, the dispenser comprising:

an outer housing defining an interior space;

stacking means mounted within the outer housing for holding a stack of individual folded webs within the interior space;

a curved dispensing face defined in the outer housing proximate to an end of the stacking means;

a stack of individual folded webs; and at least one edge of a dispensing opening in contact with the stack of individual folded webs so that a portion of the stack of individually folded webs is exposed by the dispensing opening, wherein a cross-section through the curved dispensing face has a curved shape with a line of inflection points between a convex curvature and a concave curvature, wherein an exposed edge of the stack of individual folded webs is located along a tangent plane of a convex section of the dispensing face, in a position between the line of inflection points and an edge of the dispensing opening, and a first panel of the stack of individual folded webs conforms to a shape of the curved dispensing face including the line of inflection points.

2. The dispenser of claim 1, wherein the cross-section through the dispensing face has a general S-shape.

3. The dispenser of claim 1, wherein the inflection points are provided in cross-sections through the dispensing face across at least a part of the entire width of the face.

4. The dispenser of claim 3, wherein the inflection points are located in a line adjacent the dispensing opening.

5. The dispenser of claim 3, wherein the inflection points are provided in cross-sections through the dispensing face on either side of the dispensing opening.

6. The dispenser of claim 3, wherein the inflection points are located in a line across the dispensing opening.

7. The dispenser of claim 4, wherein the inflection points are located in a line positioned in a plane substantially parallel to an outer wall of the housing.

8. The dispenser of claim 4, wherein the inflection points are located in a line positioned at an angle to a plane parallel to an outer wall of the housing.

9. The dispenser of claim 4, wherein the inflection points are located on a curved line across at least a part of the dispensing face.

10. The dispenser of claim 1, wherein the stack of individual folded webs is a stack of napkins, towels or tissues.

11. The dispenser of claim 5, wherein the inflection points are located in a line positioned in a plane substantially parallel to an outer wall of the housing.

12. The dispenser of claim 5, wherein the inflection points are located in a line positioned at an angle to a plane parallel to an outer wall of the housing.

13. The dispenser of claim 5, wherein the inflection points are located on a curved line across at least a part of the dispensing face.

14. The dispenser of claim 6, wherein the inflection points are located in a line positioned in a plane substantially parallel to an outer wall of the housing.

15. The dispenser of claim 6, wherein the inflection points are located in a line positioned at an angle to a plane parallel to an outer wall of the housing.

16. The dispenser of claim 6, wherein the inflection points are located on a curved line across at least a part of the dispensing face.

17. The dispenser of claim 1, wherein the inflection points are located on a substantially convex, curved line across at least a part of the dispensing face.

18. A dispenser for individual webs from a stack of such individual webs, the dispenser comprising:

an outer housing defining an interior space;

stacking means mounted within the outer housing for holding a stack of individual folded webs within the interior space;

a dispensing face defined in the outer housing proximate to an end of the stacking means, the dispensing face in cross-section having an approximate shape of a curve defined by an equation $y=x^3$ with an inflection point in a middle section of the dispensing face, where axes x and y define a position of the curve, in relation to the dispensing face, are located in a horizontal and a vertical plane respectively;

a stack of individual folded webs; and at least one edge of a dispensing opening in contact with the stack of individual folded webs so that a portion of the stack of individually folded webs is exposed by the dispensing opening, wherein that a cross-section through the face has a curved shape with the inflection point between a convex curvature and a concave curvature.

* * * * *